United States Patent [19]

Ingermann et al.

[11] Patent Number: 4,757,831

[45] Date of Patent: Jul. 19, 1988

[54] GOLF CLUB CLEANING MACHINE

[75] Inventors: Donald E. Ingermann, Arvada; Lonney J. Steinhoff, Evergreen, both of Colo.

[73] Assignee: Century International Corp., Golden, Colo.

[21] Appl. No.: 8,731

[22] Filed: Jan. 30, 1987

[51] Int. Cl.[4] ..... B08B 3/02

[52] U.S. Cl. ..... 134/148; 134/158; 134/182

[58] Field of Search ..... 134/137, 140, 148, 154, 134/157, 158, 182, 153, 149

[56] References Cited

U.S. PATENT DOCUMENTS

| | | | |
|---|---|---|---|
| 51,000 | 11/1865 | Alexander | 134/182 |
| 838,955 | 12/1906 | Dapron | 134/182 |
| 1,457,240 | 5/1923 | Welsh | 134/182 |
| 1,657,592 | 1/1928 | Shafer | 134/153 X |
| 1,765,647 | 6/1930 | Boehnke | 134/153 |
| 2,395,747 | 2/1946 | Loeb | 134/182 |
| 2,562,076 | 7/1951 | Weisselberg | 134/158 X |
| 3,101,089 | 8/1963 | Brown et al. | 134/184 X |
| 4,368,747 | 1/1983 | Taylor | 134/153 |

*Primary Examiner*—Harvey C. Hornsby
*Assistant Examiner*—Frankie L. Stinson
*Attorney, Agent, or Firm*—Edwin L. Spangler, Jr.

[57] ABSTRACT

This invention relates to a golf club cleaning machine characterized by a compartmented carousel having an annular tray-forming basket suspended therebeneath which holds several clubs in side-by-side upstanding circular relation for rotation therewith one-at-a-time past one or more nozzles which spray a high-pressure jet of cleaning fluid at least against the hitting face and sole of each club as it passes. An internal baffle having a concave undersurface redirects any cleaning fluid directed or splashing upwardly thereagainst back down onto the exposed portions of the club shafts and the club heads before it can reach the handgrips or otherwise escape from the machine through the opening in the lid. This baffle has inwardly-extending radially-directed slots that divide same into a plurality of individual flaps which deflect as needed to pass the club heads as they are inserted and removed from the tray.

9 Claims, 3 Drawing Sheets

10
54
52
62
72
64
72
54
22
24
60
50
66
78
48
78
74
14
101
101
103
108
102
106
102
108
14
68
44
70
46
16
92
36T
38
56
56
34
36B
12
12
100T
68
80
88
86
84
30
32
28
98
96
94
90
82
90
100B
130
20
26
18
42
40

GOLF CLUB CLEANING MACHINE

BACKGROUND OF THE INVENTION

The hitting face of a golf club should be kept clean if it is to function as intended. The grooves on the face of the club, be it wood or iron, bite into the surface of the ball and impart spin to it which is necessary if it is to fly accurately. Backspin is especially important when using the mid-to-short irons in terms of getting the ball to "hold" on the greens. A good clean surface, even on the wooden clubs, provides the friction against the dimpled exterior of the ball that enables the golfer to hook or fade it accurately which he or she could not do if the surface were dirty, grass-stained and slick. For this reason, many golfers or their caddies carry a wet towel which they use to wipe off the surface of the club after every shot.

Following each round, golfers who store their clubs in the bag room of the so-called "proshop" of a club are accustomed to having their clubs cleaned by one of the people who work there. This is a laborious and time-consuming task that calls for each club to be dipped in water, thoroughly scrubbed clean and dried before it is returned to the bag. Doing this for well over a hundred sets of clubs on a given day can truly become burdensome.

FIELD OF THE INVENTION

The present invention relates to a golf club cleaning machine.

DESCRIPTION OF THE RELATED ART

While applicants are aware of machines used to clean the golf balls, many of which are in use on driving ranges, they are unaware of any machine which will clean a whole set of golf clubs including the woods, irons and a putter, in one operation.

SUMMARY OF THE INVENTION

It has now been found in accordance with the teaching of the present invention that a machine can be made which will clean an entire set of golf clubs in a matter of thirty seconds or so through the novel expedient of spraying all exposed surfaces of the head and the exposed portion of the shafts beneath the handgrips with powerful high pressure jets of some sort of cleaning solution as the clubs are passed through these jets one-at-a-time on a carousel-like compartmented basket which is being slowly rotated. The leaves of an overhanging flexible baffle keep the water from escaping through the open top of the tank while, at the same time, churning the water thus confined over and around the club head and the portions of the shaft located generally below the handgrip so as to wet and clean every part thereof. The machine may either be coin-operated or push-button-controlled depending on what services in terms of cleaning the clubs is offered by the facility in question. If desired, the same unit can be used to provide a source of high pressure water or other cleaning solution which, when redirected through a hose and wand on the end of the hose, is conveniently employed to clean and wash down the carts before they are taken back to the cart barn, stored and recharged.

It is, therefore, the principal object of the present invention to provide a novel apparatus for cleaning several golf clubs at one time.

A second objective is the provision of the device of the class described which can be used to clean an entire set of golf clubs in a matter of a minute or so including the loading and unloading thereof.

Another object of the invention herein disclosed and claimed is to provide a labor-saving machine that is not only faster and far less time-consuming but does a better job than can be done by hand with a wet towel which is about all that is usually used to clean them.

Still another objective of the within-described invention is the provision of a machine which has its primary purpose that of cleaning a set of golf clubs but which, in addition, can serve as a high-pressure source of water or other cleaning solution that can conveniently be used for other purposes such as, for example, washing down the golf carts prior to their being stored.

An additional object of the invention forming the subject matter hereof is to provide an internally-baffled open-topped vessel containing pressurized jets of a suitable cleaning solution that keep the handgrips dry while at the same time cleaning the heads and exposed portions of the shafts.

Further objects are to provide a golf club washing and cleaning machine that is compact, versatile, movable from place-to-place, easy to use, safe, requires little or no instruction in its use, and one that is even decorative in appearance.

Other objects will be in part apparent and in part pointed out specifically in connection with the description of the drawings that follows.

DESCRIPTION OF THE PREFERRED EMBODIMENTS

Figure 1:
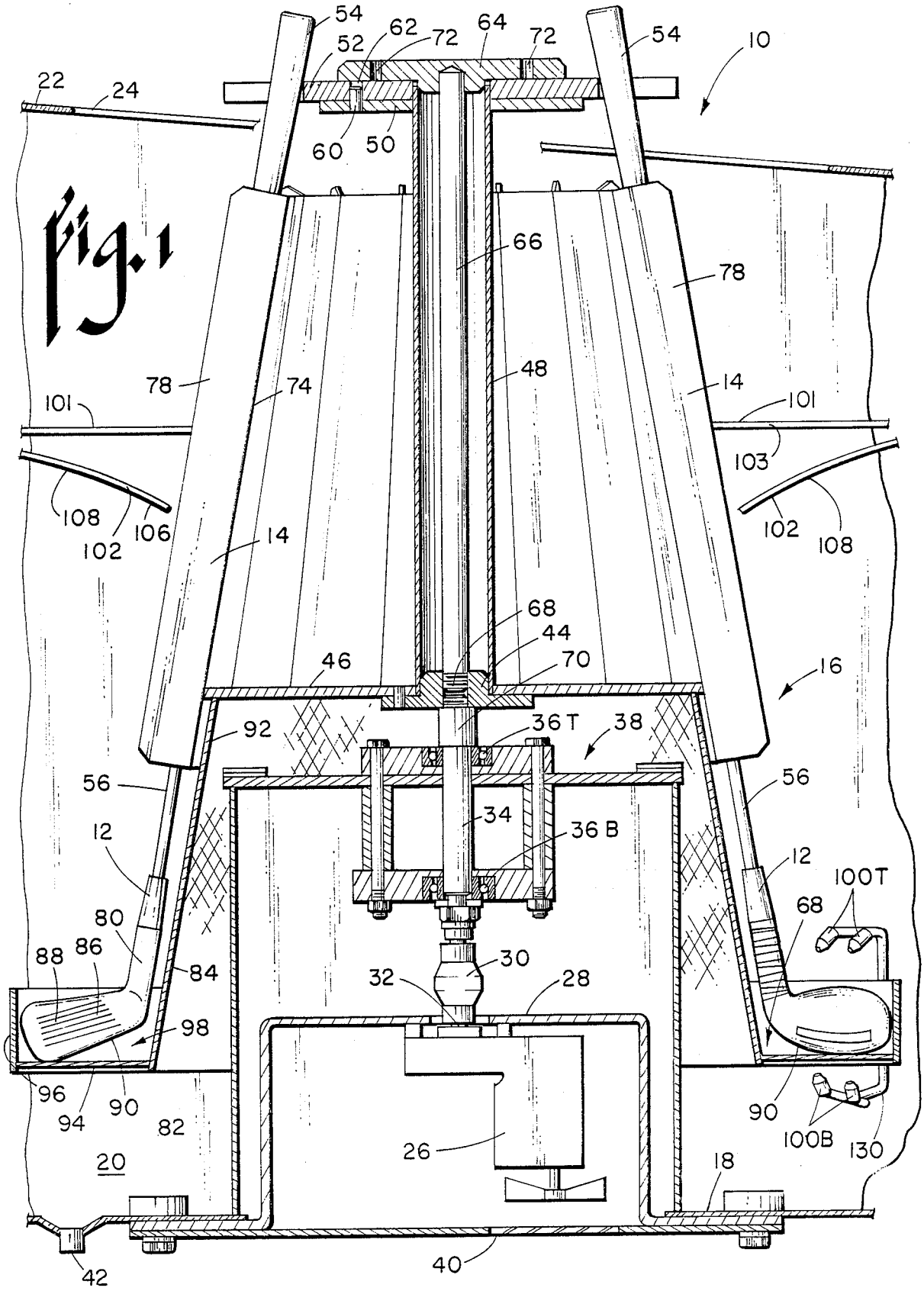
FIG. 1 is a fragmentary view showing the rotatable club-carrying carousel housed inside the open-topped vessel in which the clubs are cleaned by jets of cleaning fluid issuing from nozzles in the base.
Figure 2:
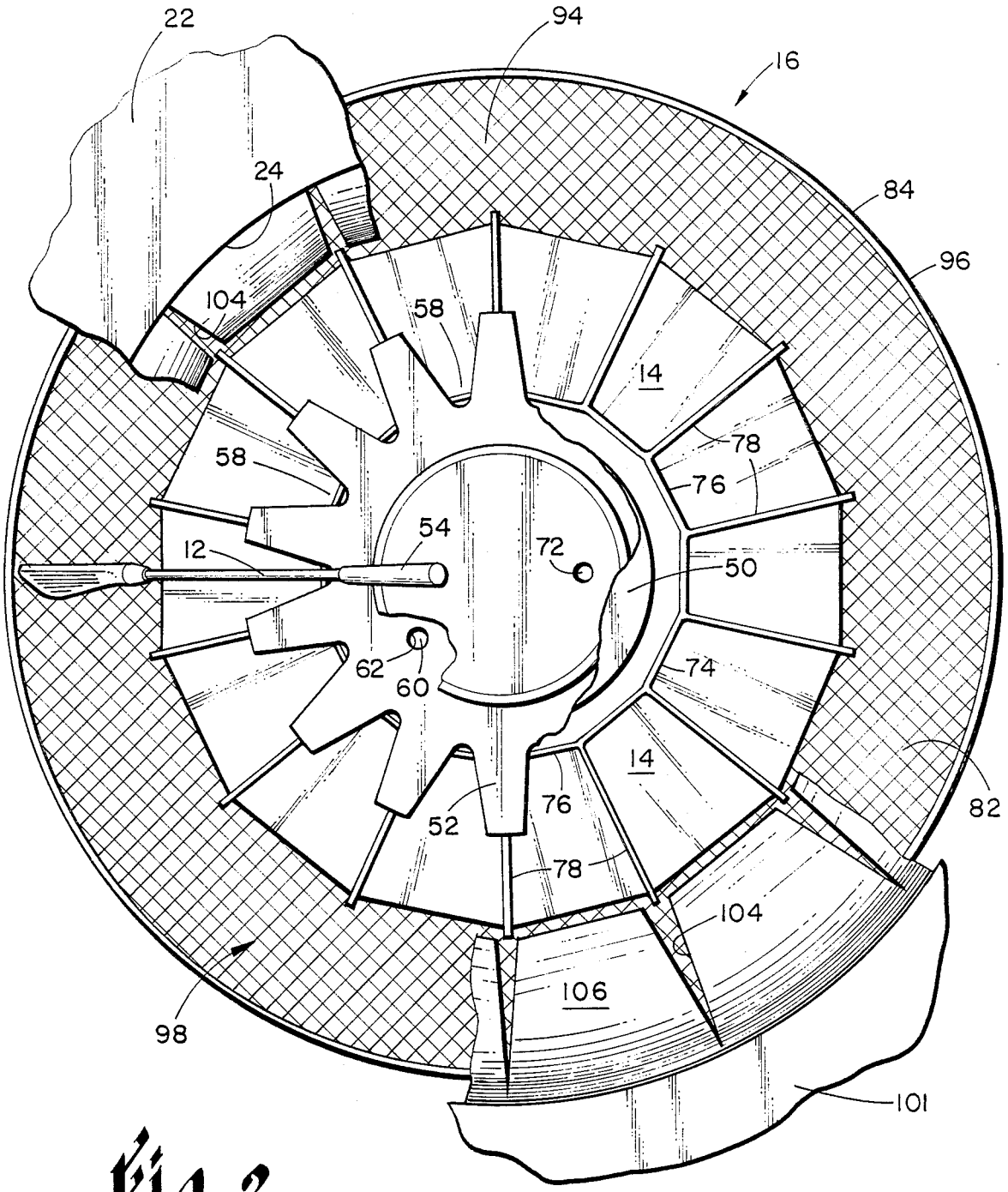
FIG. 2 is a fragmentary top plan view showing the tray-forming basket that is suspended beneath the rotatable carousel together with the baffle that overhangs the club heads seated in the basket and redirects the cleaning solution impinging thereagainst back down over the clubs; and, FIG. 3 is a schematic showing the pump circuit by means of which the cleaning fluid is delivered to the nozzles.

Referring next to the drawings for a detailed description of the present invention and, initially, to FIGS. 1 and 2 for this purpose, reference numeral 10 has been selected to broadly designate the golf club cleaning machine of the present invention in which the golf clubs 12 are held in an upright position within a plurality of individual compartments 14 arranged in angularly-spaced relation around the axis of rotation of a club-carrying carousel that has been indicated in a general way by reference numeral 16. This carousel 16 is housed inside an open-topped vessel defined by a bottom wall 18, upstanding sidewalls 20 cooperating to form a closure, and a lid 22 covering the latter. Lid 22 has an opening 24 therein (FIG. 2) and is preferably hingedly attached to the sidewalls so that it can be raised up out of the way for the purpose of removing the carousel and otherwise servicing the machine. It need not, however, be raised to access the carousel for the purpose of inserting the dirty clubs and removing them once they are clean since opening 24 is quite large.

In the particular form illustrated, the carousel is motor driven by a slow-speed gear motor 26 mounted in the base of the unit above the bottom wall 18 by means of motor-mounting bracket 28. The motor is sized to rotate the carousel slowly, say between approximately 2 and 10 rpm. Coupling 30 drivingly connects the motor shaft 32 with the driveshaft 34 of the carousel. Shaft 34 is journalled for rotation in suitable shaft bearings 36B and 36T which are, in turn, mounted upon a protective housing that has been generally indicated by reference numeral 38 and which keeps the cleaning solution away from the motor. Access to the motor 26 for the purpose of servicing same is gained through louvered coverplate 40 closing the underside of protective housing 38. Bottom wall 18 is also provided with a drain 42 outside housing 38 through which the cleaning fluid collected in the bottom of the vessel is drained.

The carousel 16 has a baseplate 44 in its bottom wall 46 that sits atop the upper end of drive shaft 34. A tubular shaft housing 48 extends upwardly from this baseplate to a similar plate 50 located at the upper end of the carousel. Resting on top of plate 50 is a marginally-toothed divider 52 which is preferably made of rubber or some similar material which will not mar the handgrips 54 on the upper ends of the club shafts 56. As seen in FIG. 2, divider 52 has the notches 58 therein aligned with the compartments 14 of the carousel. This alignment is maintained by means of a pin 60 projecting from plate 50 which enters an alignment aperture 62 in the divider. The carousel 16 is operatively attached to drive shaft 34 for rotational movement by means of cap 64 and rod 66, the threaded lower end 68 of which screws into the threaded socket 70 in the top of shaft 34. Spaced apertures 72 (only one of which is shown) in the top of the cap receive the tines of a spanner wrench (not shown) which is used to draw the cap down snug against the divider which, in turn, forces baseplate 44 at the lower end of the carousel tightly against socket 70 of shaft 34 thereby completing the driving connection between the carousel and its drive motor 26.

Carousel 16, in the particular form shown, comprises a polygonal generally frusto-pyramidal-shaped hub 74 from the intersections between the adjacent faces 76 of which project radially-extending partitions 78. These hub faces and partitions cooperate with one another to define the compartments 14 that receive and retain the uncovered portions of the golf club shafts 56 that lie between the heads 80 and the handgrips 54. The hub may, of course, be frustoconical rather than pyramidal or, for that matter, even cylindrical although a tapered configuration of some type is preferred in that it more nearly matches the inclination of the club shafts 56 and, therefore, allows the heads 80 to lie somewhat flatter against the bottom 82 of the basket 84.

In order to properly clean the club heads which are the part of the club that gets the dirtiest, it is desirable that the cleaning solution be able to reach every part thereof, but especially the hitting face 86, the grooves 88 therein which pick up the dirt and grass, and the sole 90. It is for this reason that an open basket 84 is suspended from the bottom wall 46 of the carousel. It comprises a frustoconical wall 92 (FIG. 1), a bottom wall 94 and an upstanding rim 96, all of which cooperate to define an annular tray indicated in a general way by reference numeral 98 for the reception of the club heads 80, the shafts 56 of which are confined within their individual compartments 14 as shown.

Referring to FIG. 1, it can be seen that the actual cleaning of the clubs is accomplished by spraying them with a high pressure jet of cleaning solution directed against them by one or more nozzles 100 located in the bottom of the vessel housing the carousel as they circle past one-at-a-time. In the particular form illustrated, four such nozzles are shown, two below the tray (100B) and two above (100T). Those above the tray are inclined down against the upwardly-inclined grooved hitting surfaces 88 of the clubs, whereas, the two underneath are primarily directed against the soles 90 of the club heads 80, these being the two areas that contact the turf and the ball and, for this reason, get the dirtiest. On the other hand, the uncovered portions of the shafts along with the rear and top surfaces of the club head seldom need as much cleaning if, in fact, any at all. These nozzzles are, preferably, individually adjustable so that the user can optimize their performance.

Returning once again to FIGS. 1 and 2, where yet another significant feature is shown that has yet to be described, namely, baffle-support plate 101 and baffle 102. Encircling the carousel at a level well beneath the lid 22 but above the exposed area of the basket 84 will be found this support plate together with the baffle, the latter being flexible and extending inwardly to a position closely adjacent the shaft-receiving compartments 14. Support plate 101 includes a large diameter opening 103 sized to pass the basket tray when the carousel is removed for service.

In the particular form shown, this baffle is made of rubber and it includes a plurality of angularly-spaced inwardly-extending radial slots 104 that divide it into individual flaps 106 that hang down and define a concave undersurface 108 (FIG. 1) that receives the cleaning solution directed upwardly thereagainst primarily by nozzles 100B and redirects same away from the opening 24 in the lid and back down against the uncovered areas of the club shafts and other areas of the club heads which the jets issuing from the nozzles do not impinge against directly. The resultant "churning" of the cleaning solution is effective to remove any soil that may have gotten on the shafts, tops and rear faces of the club heads. Moreover, and most important, this baffle is effective to keep the cleaning fluid away from the handgrips which are located above the latter and which may even be made of leather and, for this and other reasons, should not be wetted. The notches 104 in the baffle are, preferably, out of register with the notches 58 in the divider so that in the rare instance where any fluid escapes past the baffle, it cannot leave the machine through the opening in the lid. The flaps 106 of the baffle flex and deflect to the extent necessary to permit the club heads to either be inserted into the machine with the lid closed or removed therefrom.

Figure 3:
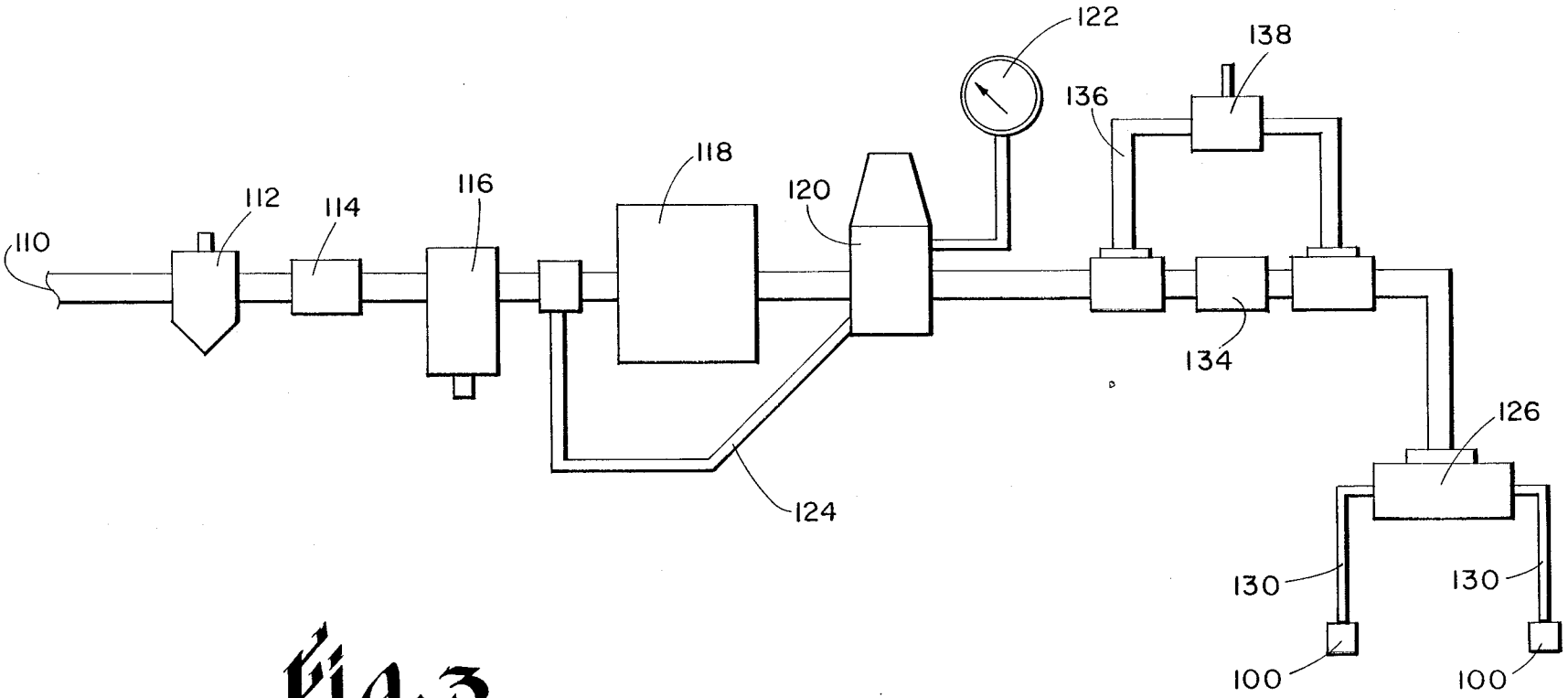

Finally, referring to FIG. 3, the more or less conventional pump system for delivering the cleaning solution to the nozzles will be described. Inlet 110 is connectable to a source of cleaning solution such as water which is deliverd to a pressure regulator 112. The source of cleaning solution may well be a hydrant or, alternatively, a sump (not shown) containing a self-contained source of some special cleaning solvent that can be recirculated and reused. The fluid leaving the pressure regulator passes through a solenoid valve 114 which has as its primary purpose that of shutting off fluid from reaching the rest of the system when the unit is not being operated. With solenoid 114 actuated to open position, the fluid passes through filter 116 and on into pump 118. Applicants have found that a pump capable of delivering a little over two gpm of solution at a pressure of about 500 psi is entirely adequate to accomplish the most difficult of cleaning jobs yet without damaging the finish on wooden club heads. While not illustrated, applicants have found it convenient and useful to provide the system with a branch connection by means of which the cleaning solution can be taken off through a hose and delivered through a hand-held wand for the purpose of cleaning golf carts and the like. If this is done, higher pressures on the order of 800 psi can be used without damaging the equipment and, therefore, a higher pressure pump should be substituted.

Downstream of the pump 118 is a so-called "unloader valve" 120 which is nothing more than a pressure-responsive valve operative to actuate at a predetermined pressure indicated by gage 122 so as to shunt the cleaning fluid away from the nozzles 100 where it could damage the finish on wooden club heads and by-pass it back to the inlet of the pump through by-pass connection 124. If one or more of the nozzles clogs up, an excessive pressure condition could, conceivably, arise in which this feature would come into play. Without it, of course, a hose could burst or, as previously noted, some damage to a club could occur.

The cleaning fluid leaving the pump under fairly high pressure is delivered directly to the manifold 126 which divides the flow and delivers it to lines 130 which feed the nozzles 100. If, on the other hand, the inlet is connected to a water line and the user decides to introduce soap or some detergent, a solenoid valve 134 can be energized to close and redirect the flow through by-pass 136 and soap dispenser 138 downstream of the pump before delivering it to the manifold 126.

Suitable circuitry (not shown) for controlling the various valves, the pump and carousel drive motor is, of course, used but it is conventional and forms no part of the present invention. Applicants envision a coin-operated machine for use at driving ranges, public golf courses and the like. It is also a simple matter to incorporate into the control circuit an automatic timer which shuts off the system after a predetermined time interval. It has been found that 30 seconds is adequate to clean all but the dirtiest of clubs with twice this time being sufficient to handle almost anything that comes along. A timer, therefore, that can be set from 0 to approximately 80 seconds is ideal.

What is claimed is:

1. A machine for cleaning golf clubs that have heads, soles, hitting faces, shafts and grips, comprising:

an outer container having a bottom wall, an upstanding sidewall, and an open top;

a golf club supporting carousel rotatably mounted in said outer container;

means for rotating said carousel;

golf club cleaning nozzle means mounted in said outer container to spray liquid cleaner onto at least the heads of golf clubs supported on said carousel as said carousel rotates;

a source of golf club cleaning liquid and means connecting said source to said golf club cleaning means and means for forcing said golf club cleaning liquid out of said golf club cleaning nozzle means;

said carousel including golf club supporting means for supporting golf clubs in an upright orientation in said outer container, said golf club supporting means including a plurality of spaced apart partitions and a flexible divider means having a plurality of fingers which are spaced apart by notches with each notch being located between adjacent partitions and which is adapted to receive a golf club shaft, said fingers being spaced apart and each being located adjacent to a partition, said divider plate being located to cover said open top and contact a golf club which is being cleaned so that the golf club shaft rests in a notch with the club head resting on said carousel;

a liquid containment means mounted on said outer container, said liquid containment means including a liquid-deflecting baffle support plate mounted on said outer container sidewall to extend radially inward therefrom at a location spaced between said outer container bottom wall and said divider plate, and a plurality of flexible liquid-deflecting baffles each attached to said baffle support plate to be located between said club cleaning nozzle means and the grips of the golf clubs being cleaned, said liquid-deflecting baffles being separated from each other by baffle notches, said baffle notches being smaller than said divider means notches and each of said liquid-deflecting baffles having a size corresponding to the spacing between adjacent partitions, whereby essentially all of the liquid from said golf club cleaning nozzle means flowing toward the golf club grips is intercepted by said liquid-deflecting baffles before such cleaning liquid contacts the grips of the golf clubs being cleaned, said liquid deflecting baffles being flexible to permit golf clubs to be inserted into said carousel via said outer container open top.

2. The golf club cleaning machine as set forth in claim 1 in which: said golf club cleaning nozzle means is positioned to spray liquid cleaner against the hitting face of each of the clubs and further includes a second nozzle means located beneath the carousel in a position to spray cleaning liquid against the soles of the golf clubs on said carousel.

3. The golf club cleaning machine as set forth in claim 1 in which: that portion of the carousel that receives the heads of the clubs comprises an open-topped angular tray-like basket.

4. The golf club cleaning machine as set forth in claim 1 which further includes: a portion of the club-carrying carousel which is adapted to carry the shafts of the golf clubs and which is generally frustoconical.

5. The golf club cleaning machine as set forth in claim 1 in which: the fluid-detecting baffle is positioned to project inwardly to points adjacent uncovered portions of the club shafts thereby redirecting the cleaning fluid away from the portions thereabove covered by a hand-grip.

6. The machine defined in claim 1 wherein said baffles have inner edges and said divider fingers have outer edges with said baffle inner edges being located radially between said nozzle means and said divider finger outer edges.

7. The machine defined in claim 1 wherein said notches are all V-shaped.

8. A machine for cleaning golf clubs that have heads, soles, hitting faces, shafts and grips, comprising:

an outer container having a bottom wall, an upstanding sidewall, and an open top;

a golf club supporting carousel rotatably mounted in said outer container;

means for rotating said carousel;

golf club cleaning nozzle means mounted in said outer container to spray liquid cleaner onto at least the heads of golf clubs supported on said carousel as said carousel rotates;

a source of golf club cleaning liquid and means connecting said source to said golf club cleaning means and means for forcing said golf club cleaning liquid out of said golf club cleaning nozzle means;

said carousel including golf club supporting means for supporting golf clubs in an upright orientation in said outer container, said golf club supporting means including a divider means located to cover said open top and contact the golf clubs which are being cleaned so that golf club shafts rest against the divider means and the club head rests on said carousel;

a liquid containment means mounted on said outer container, said liquid containment means including a liquid-deflecting baffle support plate mounted on said outer container sidewall to extend radially inward therefrom at a location spaced between said outer container bottom wall and said divider plate, and a plurality of flexible liquid-deflecting baffles each attached to said baffle support plate to be located between said club cleaning nozzle means and the golf club grips so that essentially all of the liquid from said golf club cleaning nozzle means flowing toward that golf club grips is intercepted by said liquid-deflecting baffles before such cleaning liquid contacts the grips of the golf clubs being cleaned, said liquid deflecting baffles being flexible to permit golf clubs to be inserted into said carousel via said outer container open top.

9. The machine defined in claim 8 wherein each of said liquid-deflecting flexible baffles is arcuate and positioned to curve downwardly towards the outer container bottom wall so that any liquid from said golf club cleaning nozzle means which is intercepted by said baffles is returned toward said outer container bottom wall.

* * * * *